US006267243B1

(12) United States Patent
Sumpmann et al.

(10) Patent No.: US 6,267,243 B1
(45) Date of Patent: Jul. 31, 2001

(54) CANISTER WITH DETACHABLE PREMIUM FOR CONTAINING A PARTICULATE-TYPE PRODUCT

(75) Inventors: Patrick Sumpmann; Curtis Deering, both of Maple Grove; Sarah Moberg, Minneapolis; Gordon Meier, Brooklyn Park, all of MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/448,044

(22) Filed: Nov. 23, 1999

Related U.S. Application Data

(63) Continuation-in-part of application No. 09/346,441, filed on Jul. 1, 1999.

(51) Int. Cl.[7] ..... B65D 25/14

(52) U.S. Cl. ..... 206/459.5; 206/831; 426/112; 493/53

(58) Field of Search ..... 40/312; 206/459.5, 206/831; 220/611; 229/5.84, 122.31, 132; 426/112; 493/53, 58, 59

(56) References Cited

U.S. PATENT DOCUMENTS

| | | | |
|---|---|---|---|
| 1,344,664 | 6/1920 | Wander . | |
| 2,153,911 | 4/1939 | Benedetti . | |
| 2,209,200 | 7/1940 | Hanson . | |
| 2,532,857 | 12/1950 | Ricciardi . | |
| 2,643,811 | 6/1953 | Bolding . | |
| 2,971,686 | 2/1961 | Mühlhoff . | |
| 3,155,273 | * 11/1964 | Cote | 206/831 |
| 3,207,411 | 9/1965 | Farquhar . | |
| 3,387,762 | 6/1968 | Zupon . | |
| 3,389,850 | 6/1968 | Rockefeller . | |
| 3,958,744 | 5/1976 | Herglotz . | |
| 3,994,089 | 11/1976 | Schwartz . | |
| 4,171,085 | 10/1979 | Doty . | |

(List continued on next page.)

FOREIGN PATENT DOCUMENTS

WO 99/30974 6/1999 (WO) .

OTHER PUBLICATIONS

Three–Dimensional Pioneer® Baking Mix packaging as shown in five photographs depicting different views, Copyright 1996 Pioneer Flour Mills.

Gardett's® Snak–ens Snack Mix packaging depicting front and back side views. Copyright Seville Flexpack Corporation.

Gardett's® Chips & Twists Snack Mix packaging depicting front and side panel views. Copyright 1998 Gardetto's.

*Primary Examiner*—Jim Foster
(74) *Attorney, Agent, or Firm*—John A. O'Toole; Douglas J. Taylor; Timothy A. Czaja

(57) ABSTRACT

A canister for containing a particulate-type product. The canister includes at least one side wall, a top closure and a bottom closure. The side wall defines at least a portion of an internal storage region having an upper opening and a lower opening. The side wall includes a first paper-based layer, a second layer and an adhesive. The first layer includes a main body portion and a premium. The body portion and the premium are integrally formed such that the premium is selectively detachable from the body portion. The body portion and the premium each define an inner surface and an outer surface. The second layer has an inner surface and an outer surface. The adhesive bonds the inner surface of the body portion to the outer surface of the second layer, but does not impede detachment of the premium from the body portion. The top closure is connected to the side wall to encompass the upper opening. The bottom closure is connected to the side wall so as to encompass the lower opening. With this configuration, the second layer maintains a structural integrity of the canister upon detachment of the premium.

51 Claims, 6 Drawing Sheets

U.S. PATENT DOCUMENTS

| | | | | |
|---|---|---|---|---|
| 4,306,367 | | 12/1981 | Otto . | |
| 4,308,679 | * | 1/1982 | Ray, III et al. | 40/312 |
| 4,324,058 | | 4/1982 | Sherwick et al. . | |
| 4,324,823 | * | 4/1982 | Ray, III | 40/312 |
| 4,345,393 | | 8/1982 | Price et al. . | |
| 4,353,764 | | 10/1982 | Sireix . | |
| 4,498,581 | | 2/1985 | Dutcher . | |
| 4,537,586 | | 8/1985 | Gale et al. . | |
| 4,673,126 | | 6/1987 | Hambleton . | |
| 4,819,829 | | 4/1989 | Rosten et al. . | |
| 4,840,275 | * | 6/1989 | Faiola et al. | 206/459.5 |
| 4,842,303 | | 6/1989 | Molenda . | |
| 4,880,964 | | 11/1989 | Donahue . | |
| 5,007,578 | | 4/1991 | Simone . | |
| 5,021,274 | | 6/1991 | Beck et al. . | |
| 5,078,273 | | 1/1992 | Kuchenbecker . | |
| 5,098,131 | | 3/1992 | Tucker . | |
| 5,100,180 | | 3/1992 | Tucker . | |
| 5,141,254 | | 8/1992 | Ring . | |
| 5,172,936 | | 12/1992 | Sullivan et al. . | |
| 5,199,662 | * | 4/1993 | Klupt | 242/347.2 |
| 5,324,559 | | 6/1994 | Brombacher . | |
| 5,366,142 | * | 11/1994 | Hough | 229/132 |
| 5,484,167 | | 1/1996 | Donaldson et al. . | |
| 5,566,529 | | 10/1996 | Sireix . | |
| 5,586,681 | * | 12/1996 | Policapelli | 206/459.5 |
| 5,882,746 | * | 3/1999 | Hoffman | 229/5.84 |
| 5,996,887 | * | 12/1999 | Cai et al. | 206/831 |

* cited by examiner

CANISTER WITH DETACHABLE PREMIUM FOR CONTAINING A PARTICULATE-TYPE PRODUCT

CROSS REFERENCE TO RELATED APPLICATIONS

This application is a continuation-in-part of U.S. patent application Ser. No. 09/346,441, entitled "Canister With Adhered Paper Layers For a Particulate-Type Product" filed on Jul. 1, 1999.

BACKGROUND OF THE INVENTION

The present invention relates to a canister for containing a particulate-type product. More particularly, it relates to a canister having an integrally formed, detachable premium, the removal of which does not adversely affect overall canister integrity.

An extremely popular form of packaging for dry, particulate-type products sold to consumers is a paper carton. The paper carton is normally rectangular-shaped, constructed of one or more layers of paper (such as label stock or paperboard having printing on an outer surface) and may or may not include an inner plastic liner. A wide variety of different products are packaged in this form, ranging from consumable items such as ready-to-eat (RTE) cereals and baking goods, to non-consumable items such as laundry detergents and deicing salt pellets.

Paper cartons present a number of advantages for manufactures, retailers and consumers. For example, paper cartons are relatively inexpensive to manufacture and provide a number of flat surfaces onto which product or promotional information can be displayed. Due to the rectangular, parallel-piped shape, the cartons are relatively rigid and readily stackable. Thus, the manufacturer can ship a large number of stacked cartons without experiencing product damage. Further, a retailer can maximize shelf space while fully displaying the product. Consumers likewise find the stackability characteristic desirable for home storage. Finally, paper cartons are typically sized in accordance with consumer preferences such that a desired amount or volume of product is provided within each individual carton.

Certain types of products are amenable to storage within a paper carton alone. Generally, however, a paper carton cannot, in and of itself, adequately maintain product integrity. For example, a paper carton likely will not prevent aroma, moisture, contaminants, small insects, etc. from passing through to the contained product. Thus, packaging for most particulate-type products requires an additional container or liner disposed within the paper carton. This is especially true for consumable/food products. A widely accepted technique for maintaining product integrity is to place the product into an inner container or bag that in turn is stored in the carton (commonly referred to as "bag in a box"). The bag is typically made of a plastic or glassine material and is sealed about the product. In this sealed form, the bag maintains product freshness and provides protection against insect infestation, whereas the outer paper carton provides packaging strength and display. Alternatively, a double packaging machine (DPM) technique can be employed to form a plastic or glassine liner within a paper carton. Regardless of the exact manufacturing process, the resulting packaging configuration includes a box with an inner liner. The box is a single layer paperboard or label stock material that provides structural integrity, whereas the inner liner serves as a barrier material.

The box with an inner liner packaging approach is universally employed. In fact, from a manufacturer's standpoint, box with an inner liner packaging satisfies a number important criteria including low cost, stackability, and large, flat surfaces for displaying product and promotional information. To this end, a common promotional technique is formation of a premium as part of the outer box. The premium is typically a coupon, promotional item, or graphical display directed toward a specific consumer class (e.g., a sports figure trading card) designated by appropriate printing on one or more of the outer faces of the box. The premium can assume a wide variety of shapes and sizes. Typically, however, an outer perimeter or border of the premium is defined by a printed line or series of dashed lines. While the box with an inner liner packaging, including a premium, is well-accepted, consumers may encounter several potential drawbacks. Several possible disadvantages relate generally to opening of the outer box, opening of the inner liner, dispensing of product from the opened package, and closing of the inner liner and/or outer box.

An additional concern resides in formation and removal of the above-described premium. For example, a consumer is normally required to use a scissors or knife to physically cut the premium from the outer box. This is a relatively difficult task, especially for a child, and may result in bodily harm to the consumer. Additionally, during this cutting process, the cutting implement may accidentally pierce or otherwise damage the inner liner, thereby greatly increasing the opportunity for product contamination. Similarly, removal of the premium results in a relatively large, unsightly hole in the outer box. Obviously, contaminants can more easily pass through this opening, and the overall structural integrity of the box may be negatively impacted. For these reasons, consumers tend to delay premium removal until after all of the contents of the packaging have been consumed. All too often, the consumer or other family member may unknowingly dispose of the package without removing the premium. Obviously, this oversight is detrimental to both the consumer and the supplier in that a future sale may be lost.

Manufacturers have recently attempted to overcome several of the above-described problems by incorporating a premium manufactured separately from the packaging itself For example, the premium may be formed by appropriate printing on a strip of film to which a pressure-sensitive adhesive is applied. The pressure-sensitive adhesive retains the premium at an outer surface of the box. The consumer can then simply remove the film-printed premium from the packaging without causing the above-described defects. In addition to increasing overall production costs by requiring an additional piece of material and related assembly steps, the separately produced premium presents other drawbacks. In particular, because the premium is not integrally formed with the outer box, an unscrupulous consumer can easily remove the premium from the packaging. As a result, the premium will not produce the manufacturer's desired effect, as the pilferer does not buy the product yet obtains the benefit of the premium.

Viewed as a whole, concerns relating to standard box with an inner liner packaging present numerous opportunities for consumer dissatisfaction. Essentially, consumer preferences for improvements to particulate-type product packaging can be separated into four categories. Consumers prefer that the package be easy to open, easily and satisfactorily re-closed, facilitate consistent and easy pouring and is acceptable for "clean" use by a child or others with limited dexterity. Obviously, consumers further prefer that product costs be as low as possible, and that certain other beneficial attributes associated with existing box with an inner liner packaging continue to be implemented. These existing properties includes package strength, product damage protection, use of high volume commercially available materials, visual display of product and promotional information, recycleability, stackability, and moisture, aroma, contaminant and insect protection.

Consumers continue to express a high demand for particulate-type products sold in paper cartons. However, various problems associated with use of standard packaging, and in particular box with an inner liner packages, may diminish purchasing enthusiasm. In this regard, one specific problem is presentation and removal of premiums. Alternative packaging efforts may satisfy some consumer concerns but fail to meet other expectations on a costeffective basis. Therefore, a need exists for a particulate-type product canister configured to present a relatively easily removable premium that does not otherwise negatively impact overall structural integrity.

SUMMARY OF THE INVENTION

One aspect of the present invention provides a canister for containing a particulate-type product. The canister includes at least one side wall, a top closure and a bottom closure. The side wall defines at least a portion of an internal storage region for containing a particulate-type product, the internal storage region having an upper opening and a lower opening. The side wall includes a first paper-based layer, a second layer and an adhesive. The first paper-based layer includes a main body portion and a premium. The body portion and the premium are integrally formed such that the premium is selectively detachable from the body portion. The body portion and the premium each define an inner surface and an outer surface. The second layer also has an inner surface and an outer surface. The adhesive bonds the inner surface of the body portion to the outer surface of the second layer, but does not impede detachment of the premium from the body portion. The top closure is connected to the side wall so as to encompass the upper opening. Conversely, the bottom closure is connected to the side wall so as to encompass the lower opening. With the above configuration in mind, the second layer maintains a structural integrity of the canister upon detachment of the premium. In one preferred embodiment, the canister is configured to maintain a food product, such as a ready-to-eat cereal.

Another aspect of the present invention relates to a packaged good article comprising a canister and a particulate-type product. The canister includes at least one side wall, a top closure and a bottom closure. The side wall defines at least a portion of an internal storage region having an upper opening and a lower opening. The side wall includes a first paper-based layer, a second layer and an adhesive. The first paper-based layer includes a main body portion and a premium. The body portion and the premium are integrally formed such that the premium is selectively detachable from the body portion. The body portion and the premium each define an inner surface and an outer surface. Similarly, the second layer defines an inner surface and an outer surface. Upon assembly, the adhesive bonds the inner surface of the body portion to the outer surface of the second layer, but does not impede detachment of the premium from the body portion. The top closure is connected to the side wall so as to encompass the upper opening. Conversely, the bottom closure is connected to the side wall so as to encompass the lower opening. The particulate-type product is contained within the internal storage region. With this configuration, the second layer maintains an integrity of the particulate-type product upon detachment of the premium. In one preferred embodiment, the particulate-type product is a dry, ready-to-eat cereal.

Yet another aspect of the present invention relates to a method of manufacturing a canister for containing a particulate-type product. The method includes providing a first paper-based layer having an inner surface and an outer surface. A premium is formed in the first layer, whereby the premium is selectively detachable from a remainder of the first layer. A second layer having an inner surface and an outer surface is then provided. In one preferred embodiment, the second layer is paper-based. The inner surface of the first layer is bonded to the outer surface of the second layer with an adhesive such that the adhesive does not impede detachment of the premium from the first layer. The bonded first and second layers are formed into a tubular body having an upper opening and a lower opening. The upper opening is encompassed with a top closure. Similarly, the lower opening is encompassed with a bottom closure. With this configuration, the tubular body defines an internal storage region for containing a particulate-type product. In one preferred embodiment, the resulting canister is configured to maintain a dry, ready-to-eat cereal food product.

DESCRIPTION OF THE PREFERRED EMBODIMENTS

Figure 1:
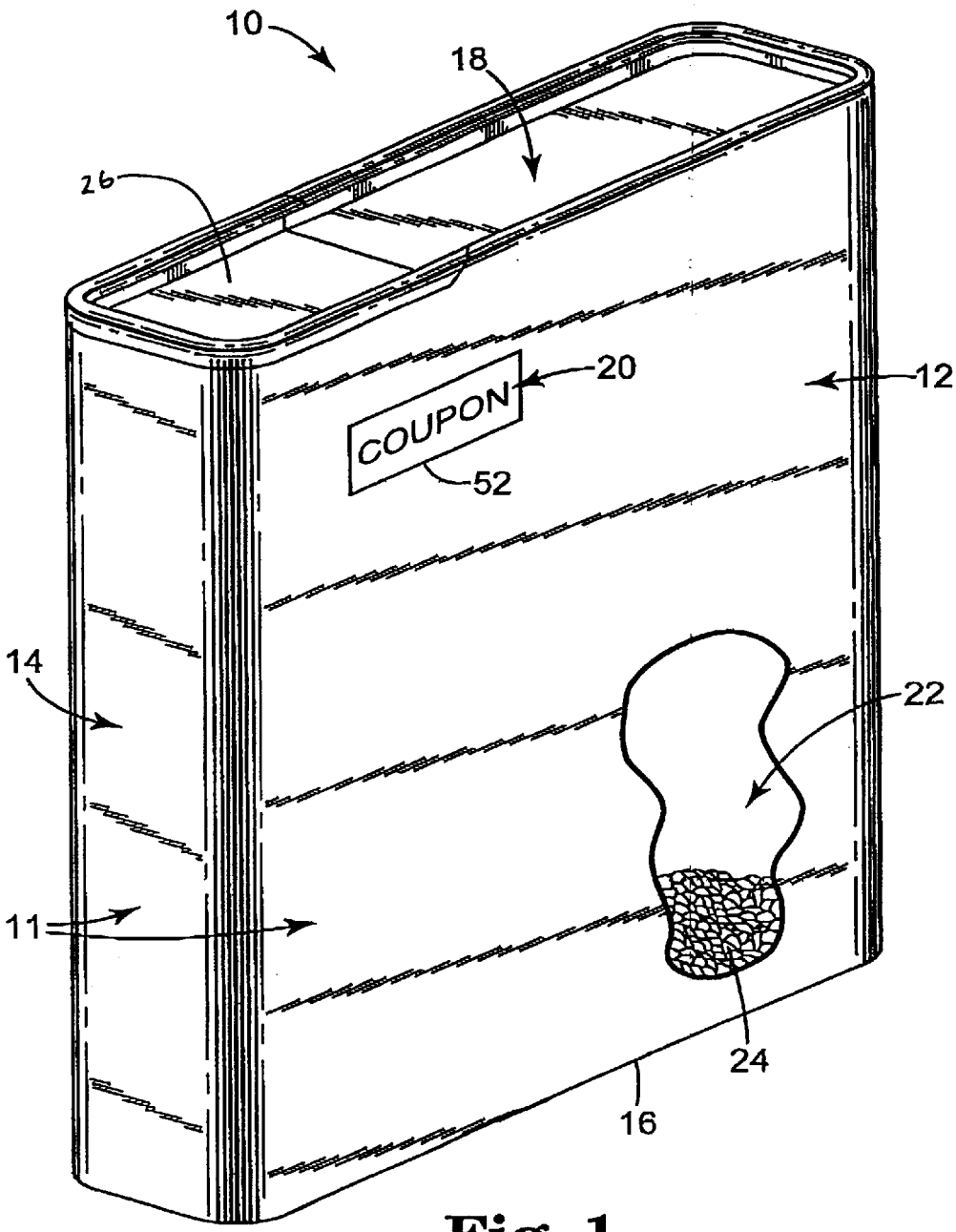
FIG. 1 is a perspective view of a canister in accordance with the present invention, with a portion cut away.

One preferred embodiment of a canister 10 is shown in FIG. 1. The canister 10 includes a side wall 11 defining opposing face panels 12 (one of which is shown in FIG. 1) and opposing side panels 14 (one of which is shown in FIG. 1), a bottom panel or closure 16 (shown partially in FIG. 1), a top panel or closure 18 and a premium 20. As described in greater detail below, the side wall 11 preferably is continuous such that the opposing face panels 12 and the opposing side panels 14 are preferably integrally formed. Thus, the term "side wall" as used throughout this specification is in reference to one or more of the opposing face panels 12 and/or the opposing side panels 14. It should be understood, however, that the opposing face panels 12 and the opposing side panels 14 can be separately formed and assembled. The bottom panel 16 is connected to the opposing face panels 12 and the opposing side panels 14 at a lower portion thereof. Similarly, the top panel 18 is connected to the opposing face panels 12 and the opposing side panels 14 at an upper portion thereof. This configuration provides an internal storage region 22 (shown partially in FIG. 1) within which a particulate-type product 24 is disposed. In one preferred embodiment, the particulate-type product 24 can be dispensed from the internal storage region 22 by opening a hinged lid 26 formed into the top panel 18. Alternatively, the top panel 18 can be entirely removable, a retractable spout can be formed, etc. Finally, the premium 20 is formed in one of the panels 12–18 (such as the opposing face panel 12 depicted in FIG. 1). Notably, directional terminology such as "bottom," "top," "upper" and "lower" is used for purposes of illustration and with reference to a desired upright orientation of the canister 10 as shown in FIG. 1. However, the canister 10 can be positioned in other orientations such that the directional terminology is in no way limiting.

Figure 2:
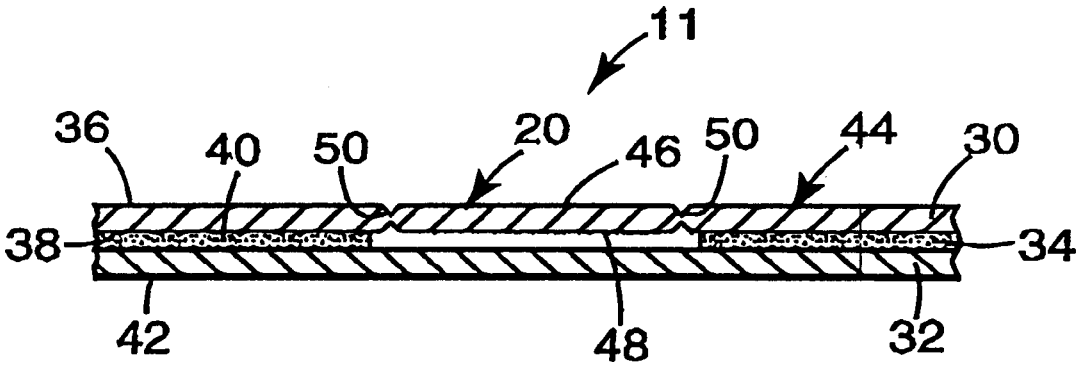
FIG. 2 is cross-sectional view of a portion of the canister of FIG. 1.

In one preferred embodiment, the side wall 11 is comprised of at least two layers, as shown in FIG. 2. The cross-sectional view of FIG. 2 depicts that portion of the side wall 11 that includes the premium 20, for example, one of the opposing face panels 12 (FIG. 1). The side wall 11 includes a first layer 30, a second layer 32 and an adhesive 34. The first layer 30 defines an outer surface 36 and an inner surface 38. As a point of reference, the outer surface 36 of the first layer 30 corresponds with an outer surface of the canister 1 0 shown in FIG. 1. Similarly, the second layer 32 defines an outer surface 40 and an inner surface 42. As a point of reference, in one preferred embodiment, the inner surface 42 of the second layer 32 corresponds with an inner-most surface of the canister 10 (i.e., defining the internal storage region 22 in FIG. 1). The premium 20 is integrally formed within the first layer 30. Finally, the adhesive 34 bonds the inner surface 38 of the first layer 30 to the outer surface 40 of the second layer 32.

The first layer 30 is a paper-based material, preferably a label stock paper material being 14 point or less in thickness. Label stock material is readily available and is highly amenable to printing on the outer surface 36. Printing onto label stock paper material is well-known in the art and may include product information, promotional statements, etc. To minimize overall costs, the label stock paper material is preferably formed from recycled paper. Alternatively, the first layer 30 can have other thicknesses and can be paperboard.

In one preferred embodiment, the second layer 32 is similarly a paper-based material, preferably paperboard having a thickness greater than 12 point. More preferably, the second layer 32 is a 42-pound linerboard. This type of material is readily available, typically akin to virgin paper. Alternatively, the second layer 32 can have other thicknesses and weights, and can be recycled label stock.

By preferably providing two different thicknesses for the first layer 30 and the second layer 32, overall costs of the side wall 11 are minimized. In other words, use of a single, thick layer of non-recycled paper inherently increases overall costs. It should be noted, however, that the first layer 30 and the second layer 32 can alternatively be identical in thickness and composition. Even further, the second layer 32 can be a layer of plastic laminated or adhered to the first layer 30. Alternatively, a plastic material or resin can be intertwined with paper fibers to form the second layer 32. The combination paper and plastic material is preferably recyclable and provides a functional barrier to at least one of flavor, aroma, moisture, oil, grease, other contaminants, insects, etc. With this one preferred embodiment, the selected plastic for the second layer 32 must be suitable for contact with the particulate-type product 24. For example, where the particulate-type product 24 is a food product, the selected material must be approved for food contact, as is well-known in the art. Thus, for example, the plastic material can be polyethylene (low destiny or high density), chlorinated plastic, ethylene vinyl acetate, polyester, nylon, polypropylene, etc. Even further, the plastic material can be various co-polymers, blends or a combination of plastic materials.

The adhesive 34 is preferably a cold adhesive. For example, the adhesive 34 can be polyvinyl-alcohol, polyvinyl-acetate, casine, starch, etc. Even further, the cold adhesive can be various blends or combinations of acceptable cold adhesive materials and/or other materials such as activators. Alternatively, the adhesive 34 can be a hot-melt adhesive, such as a polyethylene-based material with tackafiers and wax, a polypropylene-based material with tackafiers and wax, a polyester-based material with tackafiers and wax, etc. Even further, the hot-melt adhesive can be various co-polymers, blends or a combination of acceptable materials and/or other materials such as activators. Notably, cold adhesives are generally less expensive than hot-melt adhesives and typically require a reduced volume to achieve an appropriate bond. Further, cold adhesives generally do not produce an adverse "adhesive-like" odor that might otherwise adversely affect quality of the product 24 (FIG. 1) contained within the canister 10 (FIG. 1). Where the second layer 32 is paper-based, the selected adhesive 34 preferably exhibits a bond strength sufficient to rigidly secure the first and second paper layers 30, 32, such that the paper layers 30, 32 cannot easily be peeled apart (such as by a consumer under normal handling conditions). Where the second layer 32 is other than paper-based, the adhesive 34 is selected in accordance with that material to, again, prevent peeling of the layers 30, 32. Alternatively, as described below, the adhesive 34 can be formulated to delaminate when the first layer 30 is peeled away from the second layer 32. For example, the adhesive 34 can be an ethyl vinyl acetate (EVA) blend structured to delaminate in response to a peeling force.

The premiumn 20 is preferably formed as part of the first layer 30. With this in mind, the first layer 30 can be described as integrally forming a body portion 44 and the premium 20, the premium 20 defining an outer surface 46 and an inner surface 48. The outer surface 46 of the premium 20 is contiguous with the outer surface 36 of the body portion 44; whereas the inner surface 48 of the premium 20 is contiguous with the inner surface 38 of the body portion 44. Further, the premium 20 is formed to be selectively detachable from the body portion 44. For example, in one preferred embodiment, opposing score lines 50 are formed in the first layer 30, defining a perimeter 52 (shown best in FIG. 1) of the premium 20 (i.e., at the outer surface 36 and the inner surface 38). Alternatively, the score line 50 need only be formed at the outer surface 36 or the inner surface 38 of the first layer 30. Regardless, the premium 20 can easily be detached from the body portion 44 via a force normal to a plane of the side wall 11 of sufficient magnitude to sever the scored perimeter 52 (e.g., a consumer pressing on the premium 20). Alternatively, the perimeter 52 can be perforated to facilitate easy detachment of the premium 20. With this alternative embodiment, the perforations do not extend through the second layer 32, such that air and possible contaminants cannot access the internal storage region 22 (FIG. 1) via the perforations.

Various details of the premium 20 are provided below. It should be understood, however, that the adhesive 34 preferably does not contact or otherwise rigidly bond the inner surface 48 of the premium 20 to the outer surface 40 of the second layer 32. Alternatively, where the adhesive 34 is formulated to allow delamination of the layers 30, 32, the adhesive 34 can contact the inner surface 48 of the premium 20. Regardless, the adhesive 34 and the second layer 32 do not impede or otherwise restrict subsequent desired detachment of the premium 20 from the first layer 30.

Figure 3:
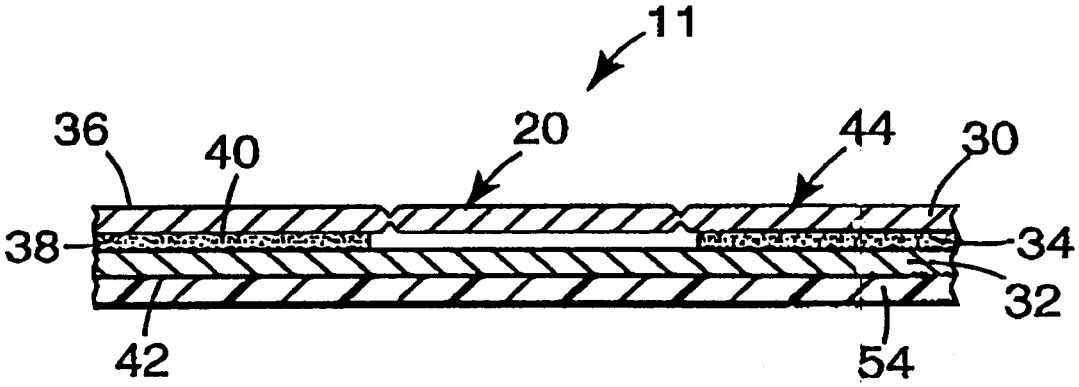
FIG. 3 is cross-sectional view of a portion of an alternative canister in accordance with the present invention.

While the side wall 11 has been described as preferably including two layers (i.e., the first layer 30 and the second layer 32), additional layers can be incorporated. For example, as shown in FIG. 3, the side wall 11 can include a third layer 54 affixed to the inner surface 42 of the second layer 32. As a point of reference, an inner surface 55 of the third layer 54 corresponds with an innermost surface of the canister 10 (i.e., defining the internal storage region 22 in (FIG. 1). The third layer 54 is preferably plastic-based and can include additional materials such as paper. In this regard, the first and second layers 30, 32 are preferably paper-based, and the third layer 54 is a plastic material as previously described in reference to the alternative embodiment of the second layer 32.

It will be further recalled that the side wall 11 has been preferably defined as forming the opposing face panels 12 (FIG. 1) and the opposing side panels 14 (FIG. 1), such that each of the panels 12, 14 are identically formed of at least two layers (i.e., the first layer 30 and the second layer 32). The premium 20, however, is preferably formed in only one of the opposing face panels 12 or opposing side panels 14, although separate premiums 20 may be formed in two or more of the panels 12, 14. Further, the premium 20 may be formed to extend from one of the opposing face panels 12 to one of the opposing side panels 14. Notably, the above-described preferred construction of the side wall 11 need only be applied to one of the panels 12, 14, where the panels 12, 14 are separately formed and assembled.

Figure 4A:
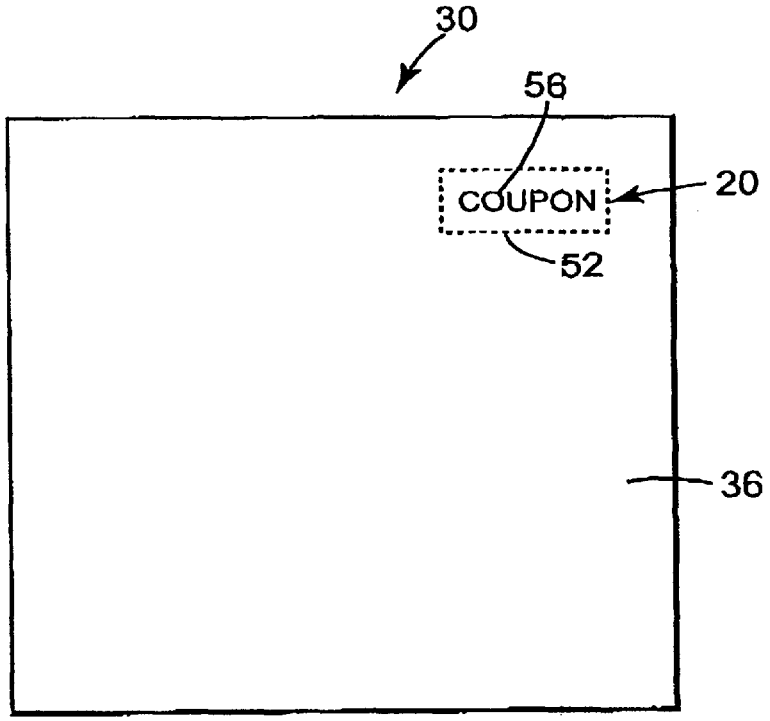
FIG. 4A is a front view of a top layer of the canister of FIG. 1.

Construction of the side wall 11 begins with formation of the first layer 30 as an elongated strip of appropriate paper material. The premium 20 is then formed in the first layer 30. As shown in FIG. 4A, the perimeter 52 of the premium 20 is formed, such as by a score line, opposing score lines, perforations, etc. Formation of score lines and/or perforations on a mass production basis is well-known in the art and can be performed by a mechanical apparatus, a laser device, etc. Notably, while the perimeter 52 is depicted in FIG. 4A as being rectangular, a wide variety of other regular or irregular shapes can be imparted.

Indicia 56 is then disposed onto the outer surface 46 of the premium 20. The indicia 56 can assume a wide variety of forms and denotes certain aspects of the premium 20. For example, the indicia 56 may designate the premium 20 as a coupon or promotional item. Alternatively, or in addition, the indicia 56 may form a word, phrase, symbol or character (such as a cartoon), picture, etc. or combination thereof that a potential purchaser may find desirable. For example, the indicia 56 may include a picture or representation of a popular television or movie character or actor. Alternatively, the indicia 56 may include a picture or representation of a sports figure, musical act, etc. Where desired, indicia or other printing can be concurrently formed on a remainder of the outer surface 36 of the first layer 30. To enhance a perceived desirability of the premium 20, portions or all of the indicia 56 can be augmented. For example, portions or all of the indicia 56 can be embossed (i.e., raised) and/or debossed (i.e., depression) in accordance with known printing techniques.

Figure 4B:
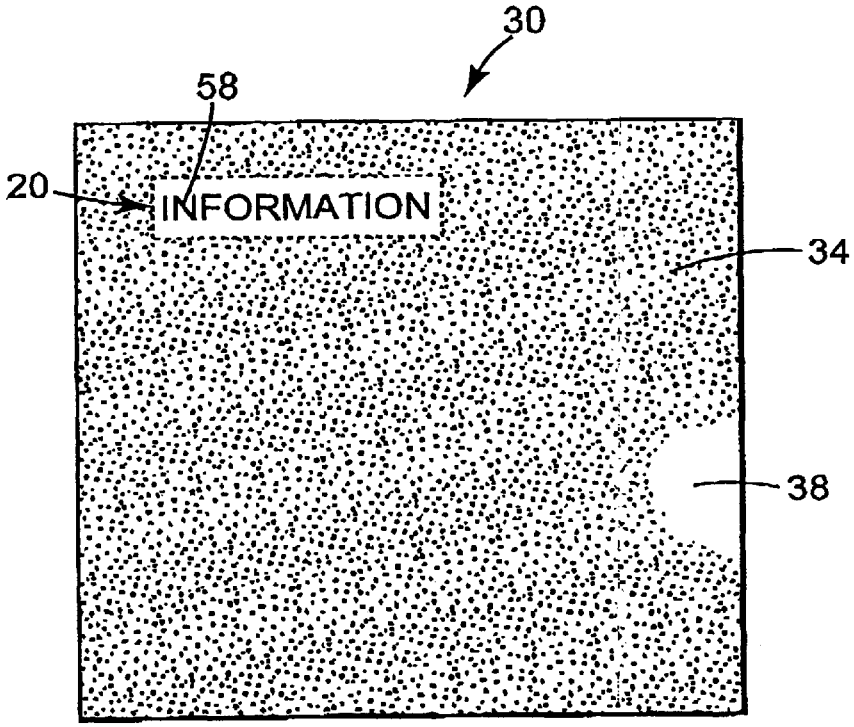
FIG. 4B is a back view of the top layer of FIG. 4A.

To further enhance the premium 20, in one preferred embodiment, separate indicia 58 is formed on the inner surface 48 of the premium 20 as shown in FIG. 4B. Similar to the indicia 56 (FIG. 4A), the indicia 58 can assume a wide variety of forms, and can include words, phrases, symbols, pictures, graphics, etc. For example, the premium 20 can be formed as a trading card. With this configuration, the indicia 56 of the outer surface 46 can include a picture of a popular sports figure, whereas the indicia 58 of the inner surface 48 can include biographical and/or statistical information relating to that sports figure. Other examples of premiums including indicia 56, 58 on both sides of the premium 20 include game pieces, redeemable coupons, etc.

The adhesive 34 is then applied to either the inner surface 38 of the first layer 30 or the outer surface 40 (FIG. 2) of the second layer 32 (FIG. 2). As shown in FIG. 4B, for example, the inner surface 38 of the first layer 30 is coated with the adhesive 34. It will be recalled that the adhesive 34 preferably exhibits a paper-to-paper bond strength that prevents peeling apart or delamination of bonded paper layers under normal handling conditions (e.g., a consumer attempting to pull one layer away from the other layer). With this preferred embodiment, the adhesive 34 is not applied to the inner surface 48 of the premium 20. For example, a roller configured (e.g., engraved) to avoid contacting the inner surface 48 of the premium 20 can be used to coat the first layer 30 with the adhesive 34. Alternatively, a release coating or liner can be first printed onto the inner surface 48 of the premium 20. A subsequent, flood coating of the adhesive 34 onto the inner surface 38 of the first layer 30 will not adhere to the printed release coating and/or the printed release coating can be removed from the inner surface 48, resulting in the desired pattern. Even further, the inner surface 38 of the first layer 30 can be flood coated with the adhesive 34, and then portions of the adhesive 34 at the inner surface 48 of the premium 20 can be removed or otherwise scraped off. Other adhesive pattern application techniques known in the art can also be employed.

In an alternative embodiment, the material selected for the adhesive 34 exhibits a paper-to-paper or paper-to-plastic bond strength that allows the two bonded layers 30, 32 to be readily delaminated or peeled apart by a consumer.

With this alternative formulation of the adhesive 34, the adhesive 34 can coat the entire inner surface 36 of the first layer 30, including the inner surface 48 of the premium 20.

While the adhesive 34 has been described as preferably being applied to the inner surface 38 of the first layer 30, the adhesive 34 can instead, or in addition, be applied to the outer surface 40 (FIG. 2) of the second layer 32 (FIG. 2). That is to say, each of the above-described coating techniques apply equally as well to coating of the outer surface 40 of the second layer 32.

Figure 5:
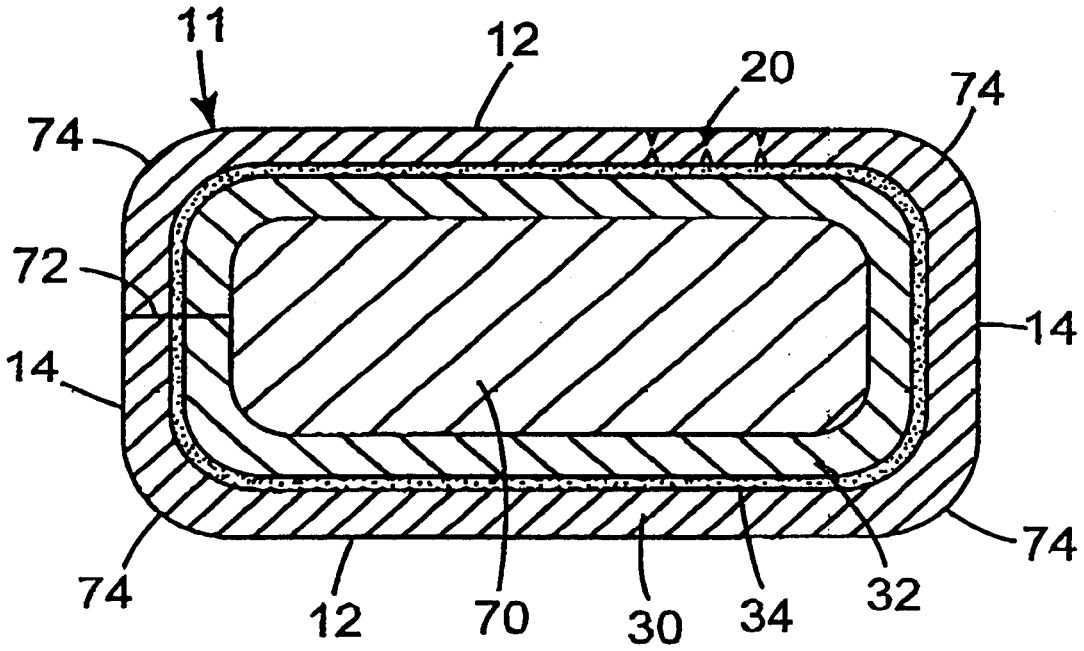
FIG. 5 is a side, cross-sectional view depicting assembly of a portion of a canister in accordance with the present invention.

Following application of the adhesive 34 to the inner surface 38 of the first layer 30 and/or the outer surface 40 of the second layer 32, the first layer 30 and the second layer 32 are bonded to one another to form the side wall 11 (FIG. 1). Subsequently, the side wall 11 is preferably articulated to define the opposing face panels 12 and the opposing side panels 14 as depicted, for example, in FIG. 5.

In one preferred embodiment, the side wall 11 is wrapped about a mandrel 70. Opposing edges of the side wall 11 are connected to form a seal 72. The seal 72 can be a butt seal as shown, but alternatively can be an overlap seal, fin seal, etc. In the wrapped position, the side wall 11 integrally forms the opposing face panels 12 and the opposing side panels 14. Notably, with this mandrel fabrication technique, corners 74 formed by the opposing face panels 12 and the opposing side panels 14 are preferably rounded or arcuate, but instead can be angular. Alternatively, the opposing face panels 12 and the opposing side panels 14 can be independently formed and subsequently connected, preferably sealed, to one another. With this approach, as few as one of the opposing face panels 12 and/or the opposing side panels 14 need include the first layer 30 and the second layer 32 bonded by the adhesive 34, although in the preferred embodiment, all of the panels 12, 14 are so-constructed. Even further, the side wall 11 need not assume a rectangular, cross-sectional shape, but instead can be circular, thereby eliminating the comers 74 such that a single, continuous panel is provided.

Figure 6:
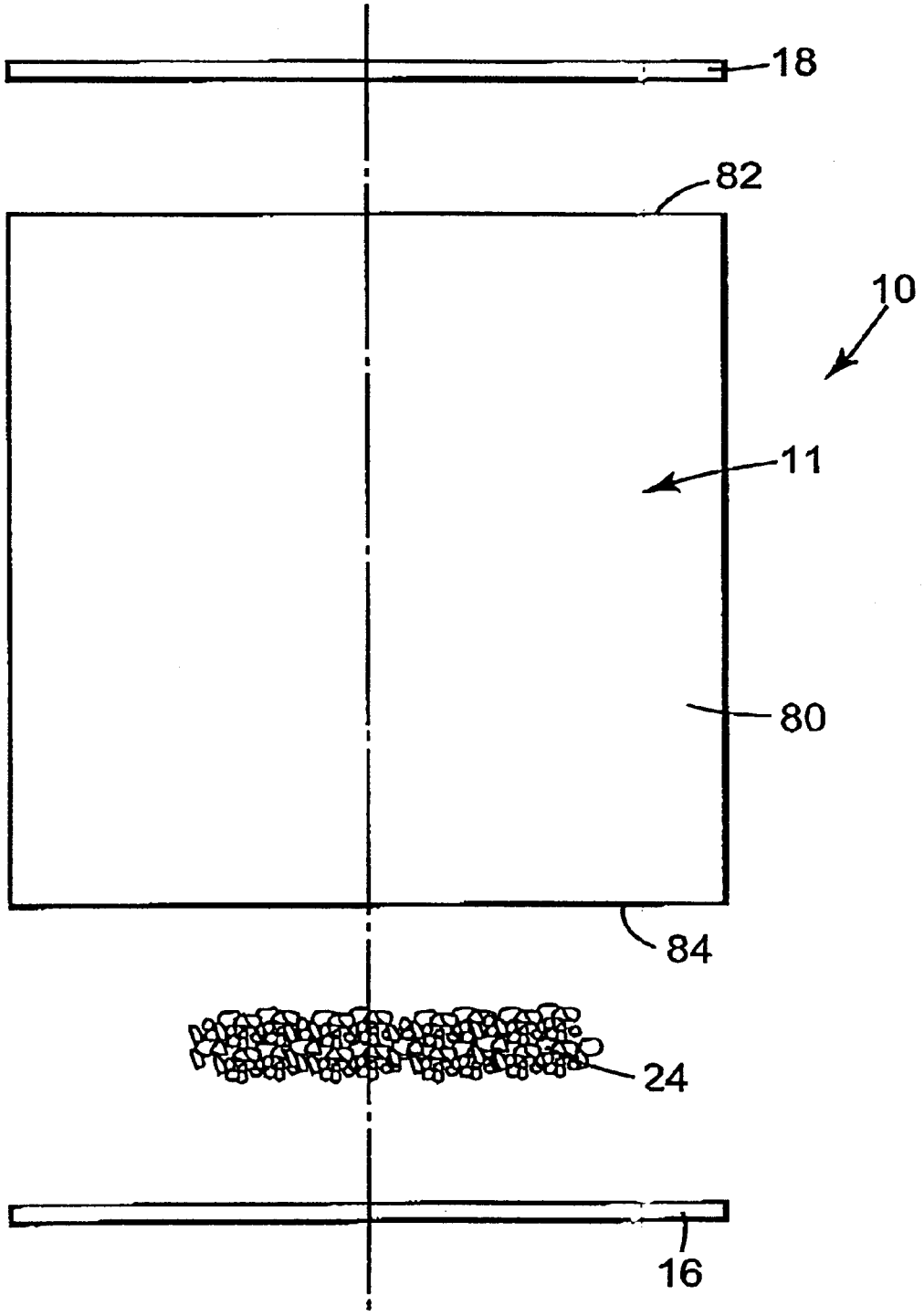
FIG. 6 is a exploded view of a canister in accordance with the present invention.

Regardless of the exact manufacturing technique, the remainder of the canister 10 is then constructed as shown in FIG. 6. In one preferred embodiment, the side wall 11 is wrapped about itself to form a tubular body 80 defining the opposing face panels 12 (one of which is shown in FIG. 6) and the opposing side panels (hidden in FIG. 6). The tubular body 80 has an upper opening 82 (shown partially in FIG. 6) and a lower opening 84 (shown partially in FIG. 6). The top panel or closure 18 is then connected to the tubular body 80 so as to encompass the upper opening 82. In this regard, the top panel 18 is preferably comprised of at least two paper-based layers, alternatively further including a plastic-based layer, similar to a construction of the side wall 11 previously described. Further, the top panel 18 can be formed to include the premium 20. Alternatively, the upper opening 82 can simply be sealed closed. The particulate-type product 24 is then placed within the internal storage region 22 (FIG. 1) defined by the tubular body 80. Finally, the bottom panel or closure 16 is connected to the tubular body 80 so as to encompass the lower opening 84. Once again, the bottom panel 18 is preferably constructed of at least two paper-based layers, similar to a construction of the side wall 11 previously described. Alternatively, the lower opening 84 can simply be sealed closed. While construction of the canister 10 has been described as preferably including placement of the top panel 18 and then the bottom panel 16, this order can be reversed.

Figure 7:
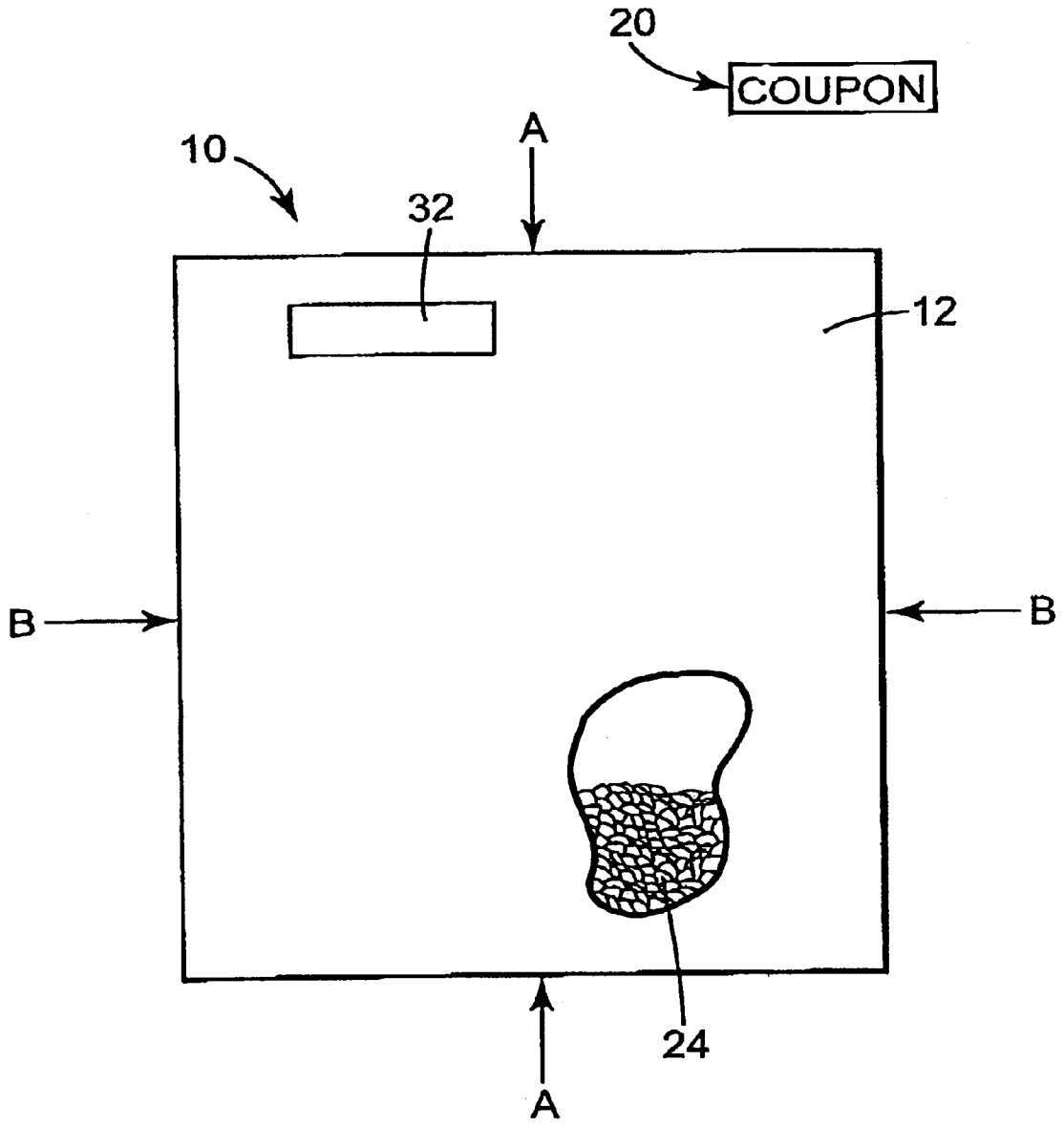
FIG. 7 is a perspective view of the canister of FIG. 1 with the premium removed.

Upon final assembly, the canister 10 is relatively rigid, able to withstand both longitudinal and transverse forces as shown in FIG. 7. That is to say, by forming at least one of the opposing face panels 12 or the opposing side panels 14 with at least two paper-based layers bonded by an adhesive, the resulting canister 10 has sufficient strength to withstand forces normally encountered during shipping and handling. By forming the perimeter 52 of the premium 20 with score lines or perforations, the premium 20 is relatively easily removable from the canister 10 without the need for a separate cutting instrument such as a scissors or knife. The adhesive 34 (FIG. 2) does not impede desired detachment of the premium 20 by a consumer. That is to say, the adhesive 34 preferably does not contact or bond the premium 20 to the second layer 32 (FIG. 2), or is formulated to readily allow delamination of the premium 20 from the second layer 32. However, some effort is still required to remove the premium 20. For example, a purchaser must place a force onto the premium 20 normal to a plane of the panel into which the premium 20 is formed (such as the face panel 12 shown in FIG. 7). This normal force (e.g., pressing the premium 20 with the user's thumb) will sever a portion of the premium 20 away from the respective panel 12. Once partially severed, the premium 20 can then be easily removed from the canister 10 via a pulling or peeling action by the user. This procedure is more difficult than use of a premium formed on a pressure adhesive-backed film. As previously described, this type of premium is likely too easily removed from the canister 10, thereby inviting unscrupulous consumers to remove the premium without actually purchasing the product. To assist in facilitating removal of the premium 20, the premium 20 may include a tab.

Importantly, removal of the premium 20 does not negatively affect the structural integrity of the canister 10 or render the canister 10 defective in terms of allowing potential contaminants to easily access and deteriorate a quality of the particulate-type product 24. As shown in FIG. 7, following removal of the premium 20, the second layer 32 of the side wall 26 remains in tact, thereby preventing passage of contaminants through the area previously occupied by the premium 20. Therefore, a purchaser is not required to delay removal of the premium 20 until after all of the product 24 has been consumed.

By providing the canister 10 with requisite packaging strength and an ability to maintain product integrity upon removal of the premium 20, the canister I0 can be used to maintain a wide variety of particulate-type products.

For example, the particulate-type product 24 can be a food product, and in particular a dry food product. One specific category of available food products is cereal-based products (e.g., formed from wheat, oats, rice, etc.). These include ready-to-eat cereals such as puffs, flakes, shreds and combinations thereof. Further, the ready-to-eat cereal product can include other ingredients such as dried fruits, nuts, dried marshmallows, sugar coatings, etc. Alternatively, other particulate-type dried food products can be contained within the container 10 such as, for example, popcorn (popped or un-popped), dried pasta (e.g., spaghetti noodles), rice, beans, pretzels, potato chips, sugar, dried milk, flour, etc. Even further, other consumable items such as bird seed can be used as the particulate-type product 24. Yet even further, non-consumable particulate-type products can be stored including fertilizer pellets, dry laundry detergent, dry dishwashing detergent, plant or vegetable seeds, de-icing salt pellets, etc.

The canister of the present invention provides a marked improvement over previous designs. Pointedly, the canister includes a selectively detachable premium, the removal of which does not negatively affect structural integrity of the canister or otherwise compromise the quality of the contained product. Further, construction of the canister to include the selectively detachable premium is relatively inexpensive and does not require use of additional materials.

Although the present invention has been described with reference to preferred embodiments, workers skilled in the art will recognize that changes may be made in form and detail without departing from the spirit and scope of the present invention. For example, the canister has been depicted as being generally rectangular in shape. Alternatively, other shapes, such as circular, are equally acceptable. Also, the canister can contain items in addition to the particulate-type product described. For example, a separate coupon or premium can be placed within the canister along with the particulate-type product. Further, while the layers comprising at least a portion of the canister have been described as being paper-based, other materials such as foil or plastic can instead be used. Further, the top or bottom panel, where employed, may be formed to include a premium.

What is claimed is:

1. A canister for containing a particulate-type product, the canister comprising:

a side wall defining at least a portion of an internal storage region for containing a particulate-type product and having an upper opening and a lower opening, wherein the side wall includes:

a first paper-based layer including:

a main body portion including an inner surface and an outer surface, a premium including an inner surface and an outer surface, wherein the body portion and the premium are integrally formed such that the premium is selectively detachable from the body portion, a weakened region being located between the premium and the body portion, a second layer, an adhesive bonding the inner surface of the body portion to a surface of the second layer, wherein the adhesive does not prevent detachment of the premiumn from the body portion and further wherein the inner surface of the premium is spaced from said surface of the second layer, said space not including said adhesive;

a top closure connected to the side wall so as to encompass the top opening; and a bottom closure connected to the side wall so as to encompass the bottom opening;

wherein the second layer maintains structural integrity of the canister upon detachment of the premium.

2. The canister of claim 1, wherein the premium is surrounded entirely by perforations, each of the perforations being of generally equal length.

3. The canister of claim 1, wherein the first layer is uncovered at the premium.

4. The canister of claim 1, wherein the premium formed within the body portion defined by a perimeter, the perimeter being structurally connected to the body portion by attachment means configured to require a force normal to the outer surface of the premium to at least initially detach the premium from the body portion.

5. The canister of claim 1, wherein the first layer is formed such that the inner surface of the body portion is contiguous with the inner surface of the premium.

6. The canister of claim 1, wherein the side wall further includes a release coating disposed on the inner surface of the premium.

7. The canister of claim 1, wherein the first layer is free of a tab extending from the outer surface of the premium for facilitating detachment of the premium from the body portion.

8. The canister of claim 1, wherein the outer surface of the premium includes indicia.

9. The canister of claim 8, wherein the inner surface of the premium includes indicia.

10. The canister of claim 1, wherein at least a portion of the outer surface of the premium is embossed.

11. The canister of claim 1, wherein at least a portion of the outer surface of the premium is debossed.

12. The canister of claim 1, wherein the second layer is paper-based.

13. The canister of claim 1, wherein the side wall further includes a third, plastic-based layer secured to the inner surface of the second layer.

14. The canister of claim 1, wherein the adhesive does not contact the inner surface of the premium.

15. The canister of claim 1, wherein the inner surface of the premium includes indicia.

16. The canister of claim 1, wherein the side wall forms a tubular body defining opposing face panels and opposing side panels, the premium being formed in at least one of the face panels or side panels.

17. The canister of claim 1, wherein the canister is configured to contain a ready-to-eat cereal.

18. A method of removing the premium from the canister of claim 1, comprising applying a force normal to the outer surface of the premium to at least initially detach the premium from the body portion.

19. A packaged good article comprising:

a canister comprising:

a side wall defining at least a tubular portion of an internal storage region having an upper opening and a lower opening, wherein the side wall includes:

a first paper-based layer including:

a main body portion including an inner surface and an outer surface, a premium including an inner surface and an outer surface, wherein the body portion and the premiumn are integrally formed such that the premium is selectively detachable from the body portion, a weakened region being located between the premium and the body portion, a second layer, an adhesive bonding the inner surface of the body portion to a surface of the second layer, wherein the adhesive does not prevent detachment of the premium from the body portion, a top panel formed apart from and connected to the side wall so as to encompass the upper opening, a bottom panel formed apart from and connected to the side wall so as to encompass the lower opening; and a particulate-type product contained within the internal storage region;

wherein the second layer maintains an integrity of the particulate-type product upon detachment of the premium.

20. The packaged good article of claim 19, wherein the premium is surrounded entirely by perforations, each of the perforations being of generally equal length.

21. The packaged good article of claim 19, wherein the first layer is uncovered at the premium.

22. The packaged good article of claim 19, wherein the premium is defined by a perimeter formed within the body portion, the perimeter being structurally connected to the body portion by attachment means configured to require a force normal to the outer surface of the premium to at least initially detach the premium from the body portion.

23. The packaged good article of claim 19, wherein the first layer is formed such that the inner surface of the body portion is contiguous with the inner surface of the premium.

24. The packaged good article of claim 19, wherein the first layer further includes a release coating disposed on the inner surface of the premium.

25. The packaged good article of claim 19, wherein the first layer further is free of a tab extending from the outer surface of the premium for facilitating detachment of the premium from the body portion.

26. The packaged good article of claim 19, wherein the outer surface of the premium includes indicia.

27. The packaged good article of claim 19, wherein the inner surface of the premium includes indicia.

28. The packaged good article of claim 19, wherein at least a portion of the outer surface of the premium is embossed.

29. The packaged good article of claim 19, wherein at least a portion of the outer surface of the premium is debossed.

30. The packaged good article of claim 19, wherein the second layer is paper-based.

31. The packaged good article of claim 19, wherein the side wall further includes a third, plastic-based layer secured to the inner surface of the second layer.

32. The packaged good article of claim 19, wherein the adhesive does not contact the inner surface of the premium.

33. The packaged good article of claim 19, wherein the adhesive contacts the inner surface of the premium and is configured to allow delamination of the premium from the second layer.

34. The packaged good article of claim 19, wherein the side wall forms a tubular body defining opposing face panels and opposing side panels, the premium being formed in at least one of the face panels or side panels.

35. The packaged good article of claim 19, wherein the particulate-type product is a dried food product.

36. The packaged good article of claim 35, wherein the particulate-type product is a ready-to-eat cereal product.

37. The packaged good article of claim 33, wherein the inner surface of the premium includes indicia.

38. A method of manufacturing a canister for containing a particulate-type product, the method comprising:

providing a first paper-based layer having an inner surface and an outer surface;

forming a premium in the first layer including forming a weakened region, whereby the premium is selectively detachable from a remainder of the first layer;

providing a second layer;

bonding the inner surface of the first layer to a surface of the second layer with an adhesive, such that the adhesive does not prevent detachment of the premium from the first layer;

forming the bonded first and second layers into a tubular body having an upper opening and a lower opening;

providing a top panel separate from the tubular body;

connecting the top panel to the tubular body so as to encompass the upper opening;

providing a bottom panel separate from the tubular body; and connecting the bottom panel to the tubular body so as to encompass the lower opening;

wherein the tubular body defines an internal storage region for containing a particulate-type product.

39. The method of claim 38, wherein forming a premium includes surrounding the premium entirely with perforations, each of the perforations being of generally equal length.

40. The method of claim 38, wherein the first layer is uncovered at the premium.

41. The method of claim 38, wherein forming the premium includes printing indicia on the outer surface of the first layer to identify the premium.

42. The method of claim 41, wherein forming the premium further includes printing indicia on the inner surface of the first layer to identify the premium.

43. The method of claim 38, wherein forming the premium includes embossing at least a portion of the outer surface of the first layer to identify the premium.

44. The method of claim 38, wherein forming the premium includes debossing at least a portion of the outer surface of the first layer to identify the premium.

45. The method of claim 38, wherein forming the tubular body includes shaping the tubular body to define opposing side panels and opposing face panels.

46. The method of claim 38, wherein bonding the first layer to the second layer includes the adhesive not contacting the inner surface of the premium.

47. The method of claim 38, wherein bonding the first layer to the second layer includes coating the inner surface of the premium with an adhesive configured to allow delamination of the premium from the second layer.

48. The method of claim 38, wherein providing a second layer includes providing a paper-based layer.

49. The method of claim 38, further including:

bonding a third plastic-based layer to the inner surface of the second layer.

50. The method of claim 47, wherein forming the premium further includes printing indicia on the inner surface of the first layer to identify the premium.

51. A canister for containing a particulate-type product, the canister comprising:

a side wall defining at least a tubular portion of an internal storage region for containing a particulate-type product and having an upper opening and a lower opening, wherein the side wall includes:

a first paper-based layer including:

a main body portion including an inner surface and an outer surface, a premium including an inner surface and an outer surface, means for detaching the premium from the body portion, wherein the body portion and the premium are integrally formed such that the premium is selectively detachable from the body portion, a second layer, an adhesive bonding the inner surface of the body portion to a surface of the second layer, wherein the adhesive does not prevent detachment of the premium from the body portion;

a top panel formed apart from and connected to the side wall so as to encompass the upper opening; and a bottom panel formed apart from and connected to the side wall so as to encompass the lower opening;

wherein the second layer maintains structural integrity of the canister upon detachment of the premium.

* * * * *